United States Patent [19]

Spann

[11] Patent Number: 4,779,869

[45] Date of Patent: Oct. 25, 1988

[54] RACKET FRAME WITH PROTECTIVE STRIP

[76] Inventor: John K. Spann, 109 St. Audley Road, Bryanston, Johannesburg, South Africa

[21] Appl. No.: 905,410

[22] Filed: Sep. 10, 1986

[30] Foreign Application Priority Data

Sep. 13, 1985 [ZA] South Africa ..... 85/7037

[51] Int. Cl.[4] ..... A63B 49/14

[52] U.S. Cl. ..... 273/73 C

[58] Field of Search ..... 273/73 R, 73 C, 73 D, 273/73 H, 326; 150/52 G, 52 M; 138/110

[56] References Cited

U.S. PATENT DOCUMENTS

| | | | |
|---|---|---|---|
| 484,578 | 10/1892 | Beecroft | 273/73 C |
| 3,117,371 | 1/1964 | Farley | 138/110 |
| 3,198,173 | 8/1965 | Fisher | 273/73 C |
| 3,582,072 | 6/1971 | Stueck | 273/73 C |
| 3,762,982 | 10/1973 | Whittington | 138/110 X |
| 4,019,736 | 4/1977 | Lehew | 273/73 R |

*Primary Examiner*—Richard C. Pinkham
*Assistant Examiner*—William E. Stoll
*Attorney, Agent, or Firm*—Stevens, Davis, Miller & Mosher

[57] ABSTRACT

A sports racket having a protector strip wound around the frame thereof in a helical path. The strip is passed between the strings of the racket with each convolution and is held in position by virtue of a set shape and the resilient or plastic memory characteristic of the strip. Preferably the set shape is a tubular helix of lesser diameter than that of the racket frame cross-section.

6 Claims, 1 Drawing Sheet

RACKET FRAME WITH PROTECTIVE STRIP

FIELD OF THE INVENTION

THIS INVENTION relates to sports rackets such as tennis and squash rackets, and more particularly, to the protection of such rackets against damage which may be inflicted when the edge of the racket strikes or scrapes across a surface such as a tennis court surface, squash court wall or other surface which may obstruct the free movement of a racket in use. Coincidentally such protection also affords protection to the article which would otherwise be struck or scraped and, in particular, it is envisaged that squash court walls will be protected by use of the expedient of this invention.

BACKGROUND TO THE INVENTION

It is well known that rackets become damaged and, in time, worn to an extent where they may break in consequence of the edge of the racket, generally in the tip region being periodically scraped against a court surface, fence, wall or other object. Many different proposals have been made in order to apply a protective layer or member over the susceptible edges of a racket but none have met with any substantial degree of success Thus, substantially rigid channel-shaped members have been proposed which clip on to the edge of a racket but these are generally heavy and may also become dislodged from the racket in use. In consequence it is common practice to simply employ a length of adhesive plaster or tape stuck to the edge of the racket. However such a plaster or adhesive tape wears through fairly rapidly and then fails to afford the required protection It is the object of this invention to provide a simple, inexpensive, yet highly effective means of protecting a sports racket which will not suffer from the disadvantages of prior art expedients.

SUMMARY OF THE INVENTION

In accordance with this invention there is provided a sports racket having wound around at least a selected portion of the frame which supports the strings, a strip of abrasion resistant, lightweight plastics material following a substantially helical path with each convolution of the strip of material passing between adjacent strings on the inside of the frame, and means for holding the elongate strip in position on the frame in use.

Further features of the invention provide for the means for holding the elongate strip in position on the frame in use, to be a set in the plastics material which is resiliently deformable from the set condition, such set condition being a helical configuration with the diameter of the helix being appreciably less, in the relaxed condition thereof, than the cross-sectional dimension of the frame such that the resiliently deformable properties of the material maintain it tightly around the frame in use.

The invention also extends to the use of a helically formed resiliently deformable, wear resistant member on a racket frame for protecting at least a region thereof.

It must be understood that the term "resiliently deformable" as used in this specification is intended to embrace within its scope any plastic material which simply has a plastic memory such that it tends to revert to a preset shape or condition.

The invention also provides a sports racket protector in the form of an elongate strip member preformed into a helical configuration of smaller diameter than the cross-sectional shape of the frame of a racket on which it is to be used, a width narrower than the spacing between adjacent strings of such racket and being made of a resiliently deformable abrasion resistant material.

The material of manufacture of the elongate strip may be of any suitable material but it has been found that certain wear resistant nylon materials are eminently suitable both from the point of view of their resiliently deformable characteristics and their wear resistant characteristics.

The strip of material generally has a width less than the spacing between adjacent strings but possibly considerably less in order to minimize weight and optimize thickness and thus durability. Thus, in the case of a tennis racket the width of the strip may be between about 0.30 inches and 0.12 inches and conveniently about 0.20 inches. In the case of a squash racket similar widths may be used provided that the strip does not engage adjacent strings. Generally it is convenient to use a width of about 0.20 inches for squash rackets as well.

Most conveniently the strip is formed to a helical configuration whereof the convolutions substantially abut each other to form, in the relaxed condition, a tubular shape. Such tubular shape, in the case of a tennis racket, generally has a diameter of between about 0.25 inches and 0.50 inches with a preferred diameter of about 0.35 inches. In the case of a squash racket, the diameter of such tubular formation is generally between about 0.16 inches and 0.40 inches with a preferred diameter of about 0.25 inches.

In order that the invention may be more fully understood, one embodiment thereof will now be described by way of example.

DETAILED DESCRIPTION WITH REFERENCE TO THE DRAWINGS

Figure 1:
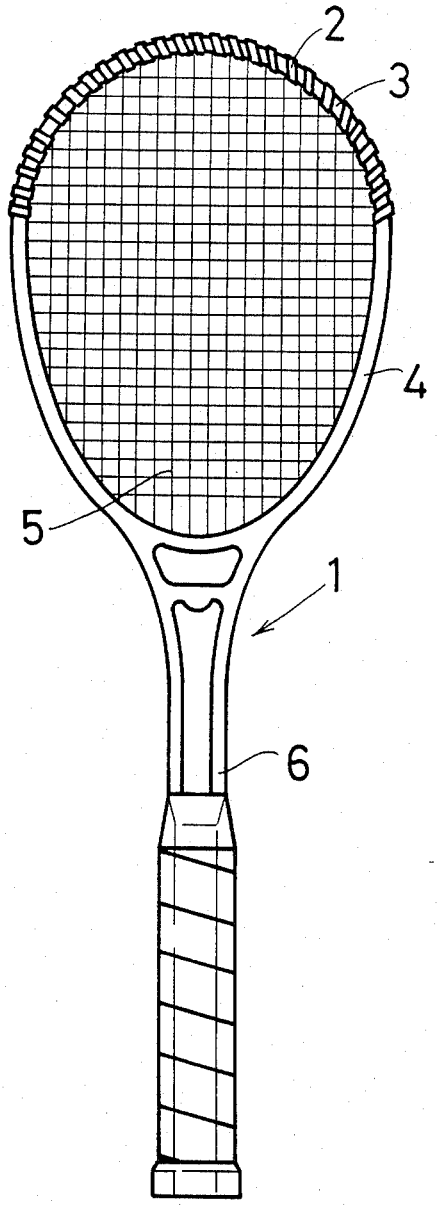
FIG. 1 is an elevation of a tennis racket fitted with means for protecting it in accordance with this invention.
Figure 2:
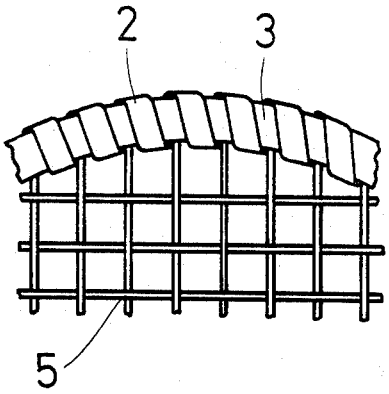
FIG. 2 is a very much enlarged elevation of a small section of the frame of the racket of FIG. 1; and, FIG. 3 is an elevation of a short section of elongate preset plastics material adapted for application to a racket in the manner illustrated in FIGS. 1 and 2.

As illustrated in FIGS. 1 and 2, a tennis racket 1 is provided with an elongate plastics strip 2 wound around the zones 3 of the frame 4 which supports the strings 5 in the region of a frame which is generally most susceptible to damage during play using the racket.

The strip 2 is wound around the frame and threaded between adjacent strings 5 so that it follows a substantially helical path around up to a half of the perimeter of the frame. Such a situation is illustrated clearly in FIG. 1.

Figure 3:
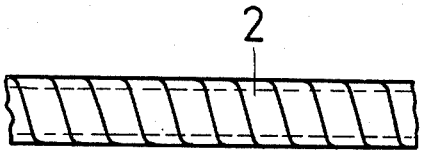

In order to ensure that the elongate strip 2 is maintained in position on the racket during use it is preformed to a substantially tubular helical configuration as shown in FIG. 3. The diameter of such helical configuration is appreciably smaller than the cross-sectional dimensions of the frame 3 so that, once the strip has been wound onto the frame, it is held tightly in position by the resiliently deformable nature of the material from which the strip is manufactured. This resiliently deformable property is generally constituted by a plastic memory.

The thickness of the strip of material is calculated to ensure a long life while maintaining an acceptably lightweight so as not to adversely affect the balance of the racket. Also, it is quite clear to those skilled in the art that the width of the strip of material must be less than the spacing between adjacent strings of the racket so as to avoid any undue wear of the strings and to facilitate installation.

Research carried out to date by applicant reveals that for tennis rackets a diameter of the preset, preformed, tubular helical strip is approximately 0.35 inches with a width of strip of 0.20 inches, a thickness of 0.04 inches and a length of about 12 inches provides excellent protection. When such a strip is manufactured from a suitable nylon material, its weight is only about 0.28 ounces.

On the other hand, an appreciably smaller diameter of helix is required for a squash racket and it has been found that a diameter of the helix may conveniently be about 0.25 inches with the width of the material remaining the same as about 0.20 inches. The thickness also can conveniently be about 0.04 inches but, in consequence of the smaller diameter, the length of the strip required for a racket is about 20 inches. Such a strip weighs about 0.175 ounces.

Where the lengths are mentioned above, it is related to the length of the helical configuration in which the edges of adjacent convolutions are substantially in contact as illustrated in FIG. 3, and not to the actual length of the strip itself.

It will be understood that the strip as above described is most easily manufactured by extruding a tube and forming a helical cut through the wall of the tube at a suitable pitch.

It will be understood that numerous different materials could be employed for the carrying out of this invention which is limited only in scope to the helical winding of a strip of protective material around the frame so as to pass between adjacent strings on the inside thereof.

I claim:

1. A sports racket having a frame, supporting strings positioned inside said frame and having wound around at least a selected portion of the frame a strip of abrasion resistant, lightweight plastics material following a substantially helical path with each convolution of the strip of material passing between adjacent strings on the inside of the frame, and means for holding the elongate strip in position on the frame in use.

2. A sports racket as claimed in claim 1 in which the means for holding the elongate strip of material in position is a set in the plastics material which is resiliently deformable from such set shape.

3. A sports racket as claimed in claim 2 in which the set shape of the plastic material is a helix of smaller diameter than the cross-section of the selected portion of the frame.

4. A sports racket as claimed in claim 1 in which the strip of plastics material has a width of between 0.12 inches and 0.30 inches.

5. A sports racket as claimed in claim 1 in which the thickness of the strip of material is about 0.04 inches.

6. A sports racket as claimed in claim 1 in which the width of the strip of material is about 0.20 inches.

* * * * *